US007471254B2

(12) United States Patent
Miura et al.

(10) Patent No.: US 7,471,254 B2
(45) Date of Patent: Dec. 30, 2008

(54) TRIPLATE PLANAR SLOT ANTENNA

(75) Inventors: Yohei Miura, Hachioji (JP); Yasuhiro Kazama, Kokubunji (JP)

(73) Assignee: Japan Radio Co., Ltd., Tokyo (JP)

( * ) Notice: Subject to any disclaimer, the term of this patent is extended or adjusted under 35 U.S.C. 154(b) by 80 days.

(21) Appl. No.: 11/666,102

(22) PCT Filed: Oct. 21, 2005

(86) PCT No.: PCT/JP2005/019419

§ 371 (c)(1),
(2), (4) Date: Apr. 23, 2007

(87) PCT Pub. No.: WO2006/043673

PCT Pub. Date: Apr. 27, 2006

(65) Prior Publication Data

US 2008/0100524 A1 May 1, 2008

(30) Foreign Application Priority Data

Oct. 22, 2004 (JP) ..... 2004-307795
Sep. 26, 2005 (JP) ..... 2005-276993

(51) Int. Cl.
*H01Q 13/10* (2006.01)
*H01Q 1/38* (2006.01)

(52) U.S. Cl. ..... 343/770; 343/700 MS

(58) Field of Classification Search ..... 343/700 MS, 343/767, 770, 846
See application file for complete search history.

(56) References Cited

U.S. PATENT DOCUMENTS 4,929,959 A * 5/1990 Sorbello et al. ..... 343/700 MS
5,453,751 A * 9/1995 Tsukamoto et al. ... 343/700 MS
5,467,100 A * 11/1995 Chen ..... 343/770
5,596,336 A * 1/1997 Liu ..... 343/770

(Continued)

FOREIGN PATENT DOCUMENTS

JP 5-343915 A 12/1993

(Continued)

OTHER PUBLICATIONS

Institute of Electronics and Communication Engineers, Antenna Engineering Handbook, Ohmsha Ltd., first edition, sixth printing, p. 705, Sep. 30, 2001.

*Primary Examiner*—Shih-Chao Chen
(74) *Attorney, Agent, or Firm*—Cohen Pontani Lieberman & Pavane LLP

(57) ABSTRACT

A triplate planar slot antenna formed by laying a ground plate, a lower layer side dielectric layer, a lower layer side copper-clad film substrate, an upper layer side dielectric layer, a slot plate and an upper layer side copper-clad film substrate sequentially from the bottom side, wherein a lower layer side copper foil piece is secured to the surface of a lower layer side insulating film by a joining technique not using adhesive, and an upper layer side copper foil piece is secured to the surface of an upper layer side insulating film by a joining technique not using adhesive. In a state where the copper foil pieces are removed, each insulating film has a dielectric constant in the range of 2.0-4.0, a tan δ in the range of 0.001-0.01, and a thickness of 25 μm or less.

8 Claims, 8 Drawing Sheets

U.S. PATENT DOCUMENTS

| | | | |
|---|---|---|---|
| 6,008,770 | A | 12/1999 | Sugawara |
| 6,158,144 | A | 12/2000 | Weber et al. |
| 6,774,316 | B1 | 8/2004 | Suzuki et al. |

FOREIGN PATENT DOCUMENTS

| | | | |
|---|---|---|---|
| JP | 6-232624 | A | 8/1994 |
| JP | 9-98016 | A | 4/1997 |
| JP | 10-13141 | A | 1/1998 |
| JP | 2002-111208 | A | 4/2002 |
| JP | 2002-290144 | A | 10/2002 |
| JP | 2002-299949 | A | 10/2002 |
| JP | 2003-504505 | A | 2/2003 |
| WO | WO 01/39561 | A1 | 5/2001 |

* cited by examiner

TRIPLATE PLANAR SLOT ANTENNA

RELATED APPLICATIONS

This is a U.S. National Phase Application under 35 USC 371 of International Application PCT/JP2005/019419, filed on 21 Oct. 2005.

1.Technical Field

The present invention relates to a triplate planar slot antenna formed by successively laminating, starting from the bottom side thereof, a ground plate, a lower side dielectric layer, a lower side copper clad film substrate, an upper side dielectric layer, a slot plate and an upper side copper clad film substrate.

2.Background Art

A conventional triplate planar slot antenna employs a structure formed by successively laminating, starting from the bottom side thereof, a ground plate, a lower side dielectric layer, a lower side copper clad film substrate, an upper side dielectric layer, a slot plate and an upper side copper clad film substrate.

In the conventional triplate planar slot antenna, the lower side copper clad film substrate comprises a lower side insulating film and a plurality of lower side copper foil pieces, which are fixed onto the surface of the lower side insulating film by an adhesive. Also, the upper side copper clad film substrate comprises an upper side insulating film and a plurality of upper side copper foil pieces, which are fixed onto the surface of the upper side insulating film by an adhesive.

The slot plate comprises a metal plate with a plurality of slots formed therein. The lower side copper foil pieces, the slots and the upper side copper foil pieces are arranged concentrically with each other, when viewed from above the triplate planar slot antenna.

Each of the insulating films comprises a polyimide insulating material in which a polyamide acid has been formed as an intermediate body, having a relative permittivity of substantially 3, and a dielectric loss tangent of substantially 0.02 (see Non-Patent Document 1). When a commercially available insulating film is used as the above insulating films, the thickness thereof is substantially 50 μm at a minimum.

Non-Patent Document 1: Institute of Electronics and Communication Engineers, Antenna Engineering Handbook, published by Ohmsha, p. 705, Sep. 30, 2001, first edition, sixth printing.

DISCLOSURE OF THE INVENTION

Problems To Be Solved By The Invention

Generally, a planar antenna using a dielectric substrate has a larger dielectric loss at higher working frequencies. This results in the planar antenna having a significantly lower gain. In view of its lower gain, if the planar antenna is adapted to serve as a high gain antenna, the size thereof must become larger, however in this case, the antenna efficiency may become disadvantageously lower.

In the above-mentioned triplate planar slot antenna, a plurality of copper foil pieces are fixed onto the surfaces of the lower side insulating film and the upper side insulating film by an adhesive. In this case, the relative permittivity and the dielectric loss tangent of the adhesive are larger than those of each of the insulating films, respectively. Accordingly, the total relative permittivity and the total dielectric loss tangent of the adhesive and the insulating films, from which the plurality of copper foil pieces have been removed, are larger than those of only the insulating films. Thus, the dielectric loss may detrimentally increase.

Incidentally, the term "total relative permittivity" means the overall relative permittivity, wherein the adhesive and the insulating films are regarded collectively as one dielectric material.

Also, a commercially available insulating film having a relatively high relative permittivity, is used for the above-mentioned insulating films. Since the thickness thereof is substantially 50 μm at a minimum, the dielectric loss may disadvantageously increase.

The present applicant has discovered that when the working frequency range of the triplate planar slot antenna is narrow, antenna characteristics such as the VSWR (voltage standing wave ratio) hardly change, even if the thicknesses of each of the lower side dielectric layer and the upper side dielectric layer change. However, when the working frequency range is wide, the antenna characteristics change if such thicknesses thereof change. Therefore, when manufacturing triplate planar slot antennas for use over a wide frequency range, characteristic variations between the antennas may result as a result of variations in thicknesses of the dielectric layers.

The present invention was made to solve the above problems, wherein an object of the present invention is to provide a high-efficiency triplate planar slot antenna in which the dielectric loss of the dielectric film, from which copper foil pieces have been removed, can be made small even if the antenna size is large.

Further, another object of the present invention is to provide a triplate planar slot antenna in which characteristic variations between antennas can be prevented, even if the working frequency range is wide.

Means For Solving The Problems

According to the present invention, a triplate planar slot antenna comprises a ground plate, a lower side dielectric layer, a lower side copper clad film substrate, an upper side dielectric layer, a slot plate and an upper side copper clad film substrate, wherein the triplate planar slot antenna is formed by successively laminating, starting from a bottom side thereof, the ground plate, the lower side dielectric layer, the lower side copper clad film substrate, the upper side dielectric layer, the slot plate and the upper side copper clad film substrate. The lower side copper clad film substrate comprises a lower side insulating film and a lower side copper foil piece fixed onto a surface of the lower side insulating film by adhesiveless bonding, and the upper side copper clad film substrate comprises an upper side insulating film and an upper side copper foil piece fixed onto a surface of the upper side insulating film by adhesiveless bonding. Each of the insulating films from which only the copper foil pieces have been removed has, within a working frequency thereof, a relative permittivity ranging from 2.0 to 4.0, and a dielectric loss tangent ranging from 0.001 to 0.01.

Also, according to the present invention, there is provided a triplate planar slot antenna comprising a ground plate, a lower side dielectric layer, a lower side copper clad film substrate, an upper side dielectric layer, a slot plate, and an upper side copper clad film substrate, wherein the triplate planar slot antenna is formed by successively laminating, starting from a bottom side thereof, the ground plate, the lower side dielectric layer, the lower side copper clad film substrate, the upper side dielectric layer, the slot plate and the upper side copper clad film substrate. The lower side copper clad film substrate comprises a lower side insulating film and a lower side copper foil piece fixed onto a surface of the lower side insulating film by adhesiveless bonding, and the upper side copper clad film substrate comprises an upper side insulating film and an upper side copper foil piece fixed onto a surface of the upper side insulating film by adhesiveless bonding. Further, each of the dielectric layers has a thickness ranging from 0.04λ0 to 0.08λ0, where λ0 represents a free space wavelength at a center frequency within a frequency range of the triplate planar slot antenna, and a total relative permittivity of the lower side dielectric layer, the lower side insulating film and the upper side dielectric layer is in a range from 1.0 to 1.1 within a working frequency of the triplate planar slot antenna.

Further, each of the insulating films preferably has a thickness of 25 μm or less.

Still further, each of the dielectric layers preferably has a relative permittivity ranging from 1.0 to 1.2.

Furthermore, each of the dielectric layers preferably comprises an insulating foam sheet, wherein the foam sheet is preferably formed by slicing a sheet-like foam material at either surface thereof.

Still furthermore, each of the insulating films preferably comprises a liquid crystal polymer.

Also, the working frequency may range from 15 GHz to 40 GHz.

BEST MODE FOR CARRYING OUT THE INVENTION

Figure 1:
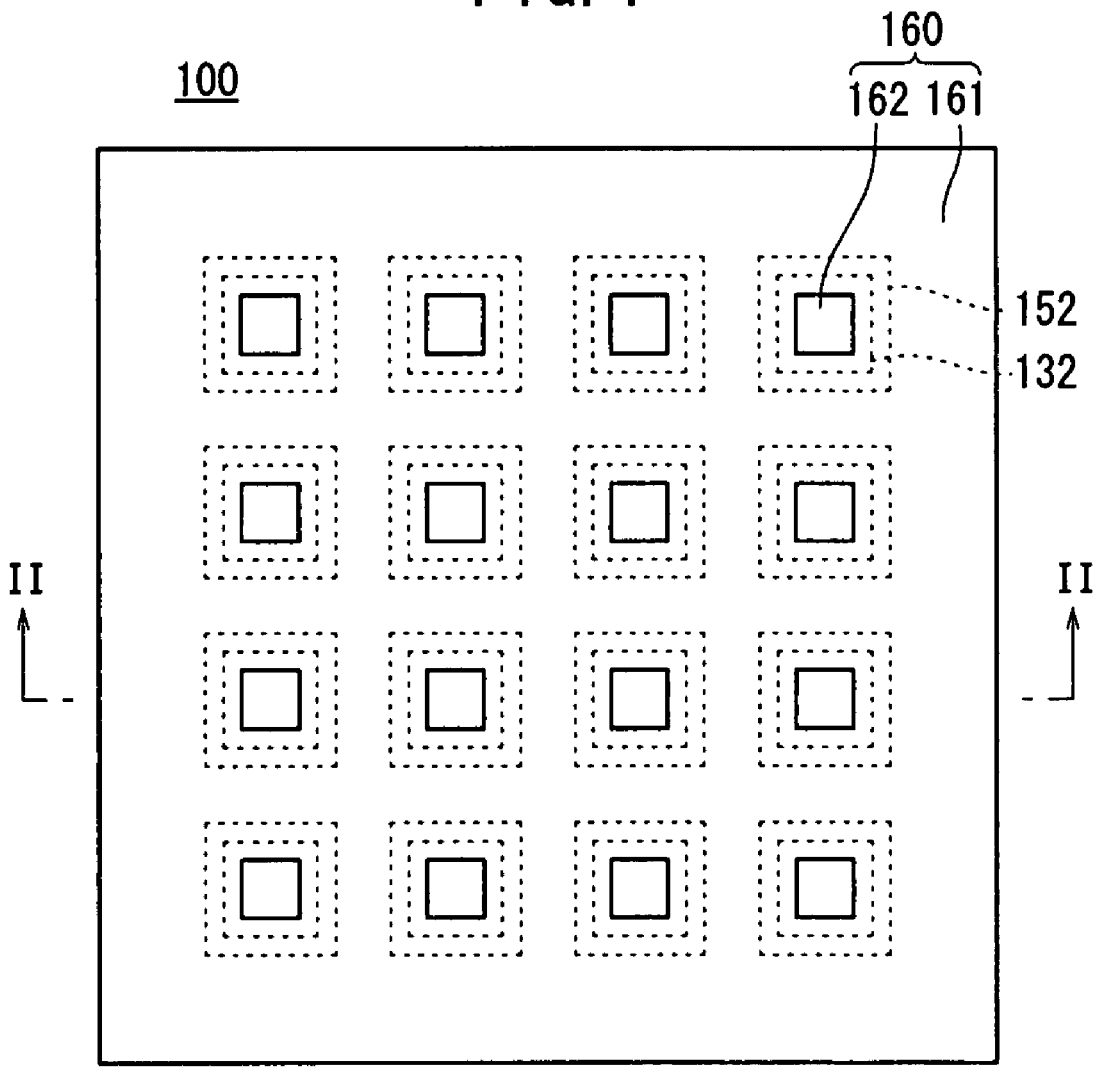
FIG. 1 is a plan view of a triplate planar slot antenna according to an embodiment of the present invention.
Figure 2:
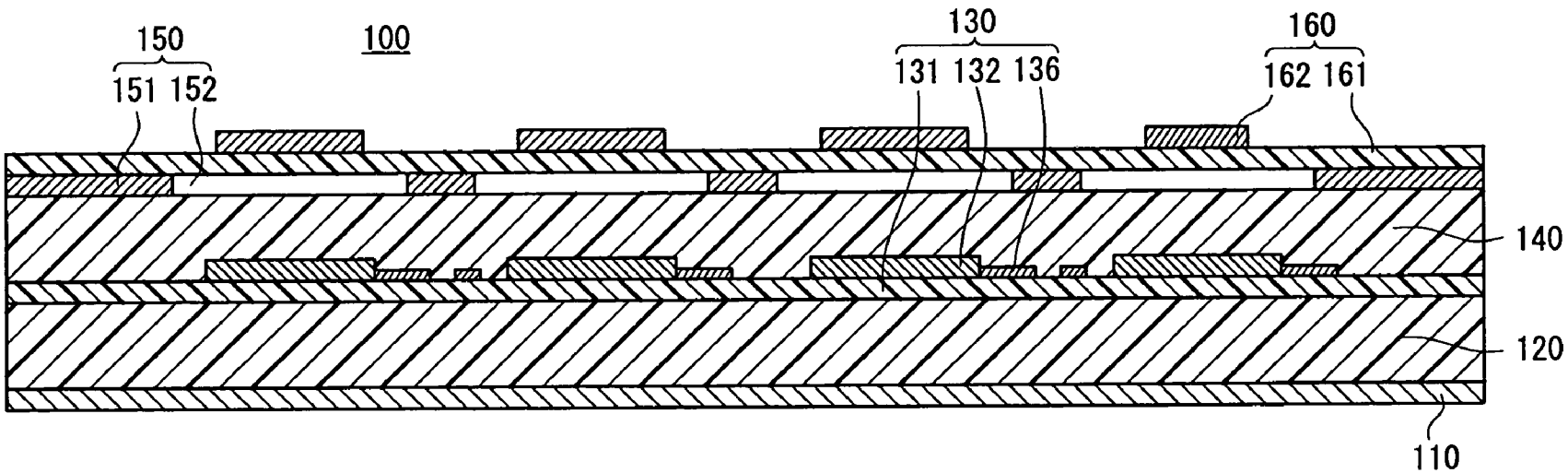
FIG. 2 is a sectional view taken along line II-II of FIG. 1.

FIG. 1 is a plan view of a triplate planar slot antenna 100 according to an embodiment of the present invention. FIG. 2 is a sectional view taken along line II-II of FIG. 1, and FIG. 3 is an exploded perspective view of the triplate planar slot antenna 100.

Figure 3:
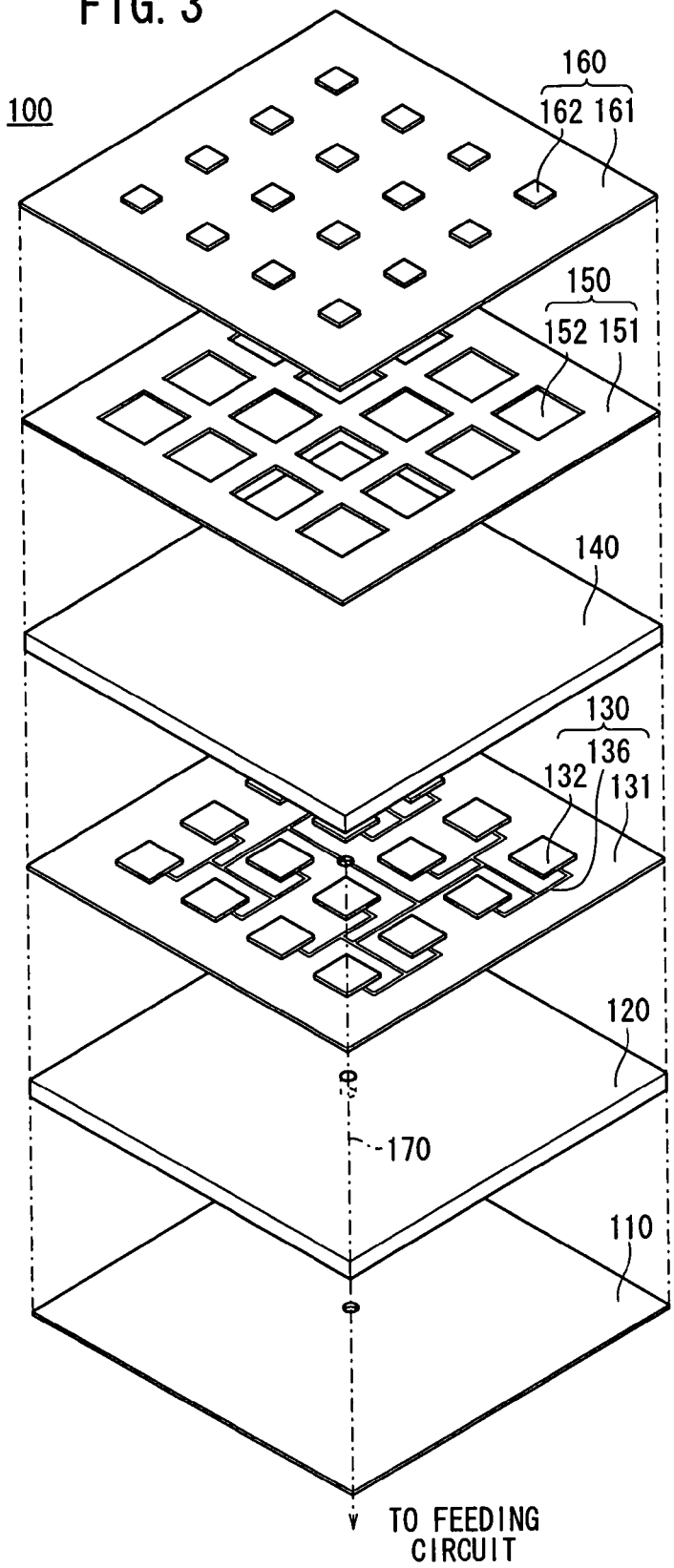
FIG. 3 is an exploded perspective view of the triplate planar slot antenna shown in FIGS. 1 and 2.

As shown in FIGS. 2 and 3, the triplate planar slot antenna 100 is made up of a structure formed by successively laminating, starting from the bottom side thereof, a ground plate 110, a lower side dielectric layer 120, a lower side copper clad film substrate 130, an upper side dielectric layer 140, a slot plate 150, and an upper side copper clad film substrate 160. The antenna 100 preferably has a working frequency ranging from 15 GHz to 40 GHz, depending on the size of the antenna, practical considerations, etc., wherein the antenna 100 is suitable for use as a planar antenna for FWA (Fixed Wireless Access), for example.

The ground plate 110 comprises a rectangular metal plate, which is placed at the bottom of the triplate planar slot antenna 100.

Each of the rectangular lower and upper side dielectric layers 120, 140, as shown in FIGS. 2 and 3, comprises an insulating foam sheet (e.g., a polypropylene foam sheet) in which the foam thereof (not shown) is substantially uniformly distributed.

In this case, while among commercially available foam materials, there are sheet-like foam materials and block-like foam materials, the foam sheet preferably is formed by slicing a sheet-like foam material (e.g., a polypropylene foam material) on either surface thereof. This is because the foam is more uniformly distributed inside of a sheet-like foam material, compared to a block-like foam material. Further, since the surfaces have a relatively small amount of foam in the sheet-like foam material, it is possible to obtain a foam sheet inside of which the foam thereof is substantially uniformly distributed, by slicing the sheet-like foam material at the surfaces thereof.

Each of the lower and upper side dielectric layers 120, 140 preferably has a thickness ranging from 0.04λ0 to 0.08λ0, where λ0 represents a free space wavelength at a center frequency f0, in a certain frequency range lying within a working frequency (15 GHz to 40 GHz) of the triplate planar slot antenna 100.

As mentioned above, by using the above foam sheet, the lower and upper side dielectric layers 120, 140 have, within the working frequency range (15 GHz to 40 GHz) thereof, a relative permittivity of 1.0 to 1.2, which is substantially equal to the relative permittivity of air.

The lower side copper clad film substrate 130, as shown in FIGS. 2 and 3, comprises a lower side insulating film 131 and a plurality of lower side copper foil pieces 132, which are fixed at certain intervals onto the upper surface of the lower side insulating film 131 using an adhesiveless bonding technology. Also, the upper side copper clad film substrate 160 comprises an upper side insulating film 161 and a plurality of upper side copper foil pieces 162, which are fixed at certain intervals onto the upper surface of the upper side insulating film 161, similarly, using an adhesiveless bonding technology.

Incidentally, the above-mentioned adhesiveless bonding technology comprises a method for fixing each of the copper foil pieces 132, 162 onto the surfaces of the insulating films 131, 161 without an adhesive, i.e., by means of pressure welding including press working, such as by means of a hot press.

Each of the rectangular insulating films 131, 161 comprises a liquid crystal polymer in order to promote low hygroscopicity inside of the antenna. Thus, the antenna is less subject to developing deteriorated characteristics, even when used in high-humidity environments. Each of the insulating films 131, 161 has a thickness of 25 μm or less, and further, has a relative permittivity of 2.0 to 4.0 and a dielectric loss tangent of 0.001 to 0.01, in the above working frequency range (15 GHz to 40 GHz) of the antenna.

The rectangular copper foil pieces 132, 162 are fixed respectively onto the surfaces of the insulating films 131, 161 without an adhesive, by means of an adhesiveless bonding technology.

A feed path 136 made of a metal foil is fixed onto the upper surface of the lower side insulating film 131 without using an adhesive, i.e., by means of an adhesiveless bonding technology, wherein the feed path 136 is connected to each of the lower side copper foil pieces 132. The lower side copper foil pieces 132 are connected in parallel to a feeding circuit (not shown) through the feed paths 136 and 170.

As mentioned above, the copper foil pieces 132, 162 and the feed path 136 are fixed respectively onto the surfaces of the insulating films 131, 161 without using an adhesive, by means of an adhesiveless bonding technology. Thus, each of the insulating films 131, 161, from which the copper foil pieces 132, 162 and the feed path 136 have been removed, has a relative permittivity (2.0 to 4.0) and a dielectric loss tangent (0.001 to 0.01), which are equal to those inherent in the insulating films 131, 161, within the working frequency range (15 GHz to 40 GHz).

The rectangular slot plate 150 comprises a metal plate 151 with a plurality of rectangular slots 152 formed therein. As shown in FIG. 1, the lower side copper foil pieces 132, the slots 152 and the upper side copper foil pieces 162 are arranged substantially concentrically with each other, when viewed from above the triplate planar slot antenna 100.

Further, as shown in FIG. 2, the triplate planar slot antenna 100 comprises a triplate structure, in which the lower side dielectric layer 120, the lower side copper clad film substrate 130 and the upper side dielectric layer 140 are interposed between the ground plate 110 and the slot plate 150, and further in which the lower side copper foil pieces 132 are disposed substantially at an intermediate portion (i.e., at a vertically intermediate portion as shown in FIGS. 2 and 3).

When the lower and upper side dielectric layers 120, 140 are formed from the above-mention foam sheet, the triplate structure, comprising the lower side dielectric layer 120, the lower side insulating film 131 and the upper side dielectric layer 140, has a total relative permittivity of 1.0 to 1.1 within the working frequency range (15 GHz to 40 GHz).

Incidentally, the term "total relative permittivity" means an overall relative permittivity, in which the lower side dielectric layer 120, the lower side insulating film 131 and the upper side dielectric layer 140 are regarded collectively as making up one dielectric material.

In the triplate planar slot antenna 100, as shown in FIG. 3, for example, when the feeding circuit supplies a signal through the feed paths 170 and 136 to each of the lower side copper foil pieces 132, then based on the supplied signal, each of the lower side copper foil pieces 132 emits electric waves outside through the slots 152.

The triplate planar slot antenna 100 according to the embodiment of the present invention is constructed as described above. Effects thereof shall be explained below with reference to FIGS. 1 to 8.

FIGS. 4 to 8 are graphs (solid lines) showing the relationship between the VSWR (voltage standing wave ratio) of the triplate planar slot antenna 100 (see FIGS. 1 to 3) and any frequency f with respect to a center frequency f0. The graphs are classified based on the thicknesses of the lower side dielectric layer 120 and the upper side dielectric layer 140. Dotted lines in FIGS. 4 to 8 indicate the frequency range (f/f0=0.925 to 1.075) of the triplate planar slot antenna 100. In this case, if the VSWR at f/f0 within the frequency range is lower than the VSWR (1.5) indicated by the dotted line, it is judged that the triplate planar slot antenna 100 is usable at the frequency range f/f0.

Figure 4:
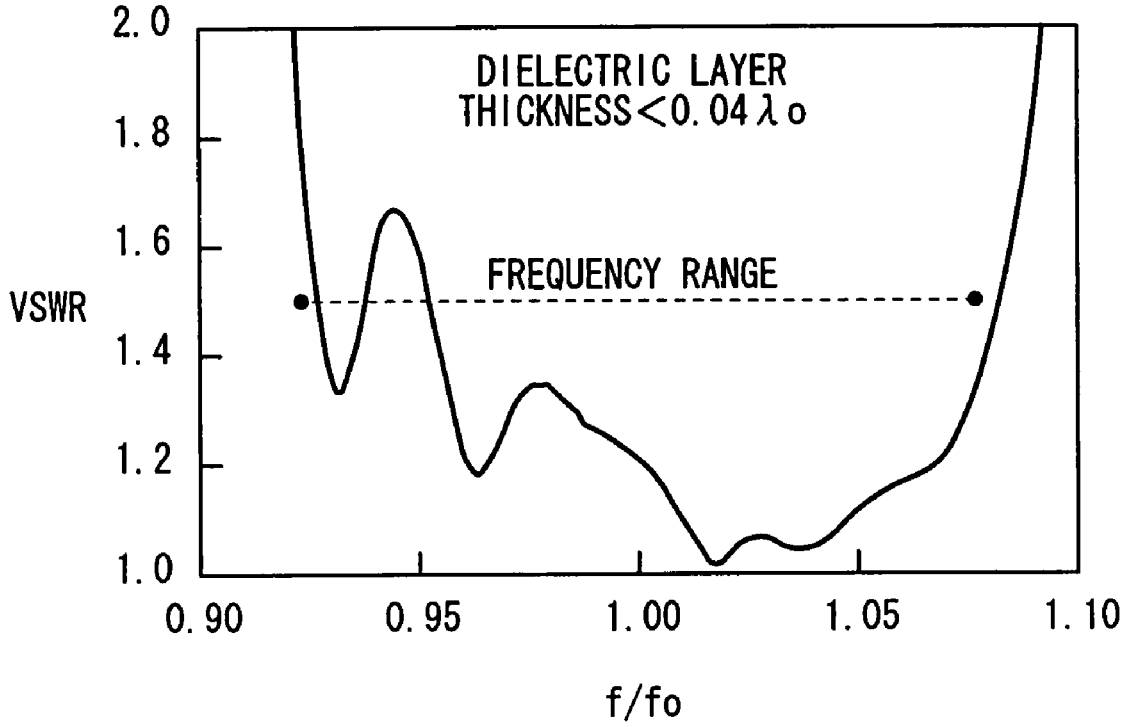
FIG. 4 is a graph showing a relationship between VSWR and f/f0, when a dielectric layer has a thickness of less than 0.04λ0.
Figure 5:
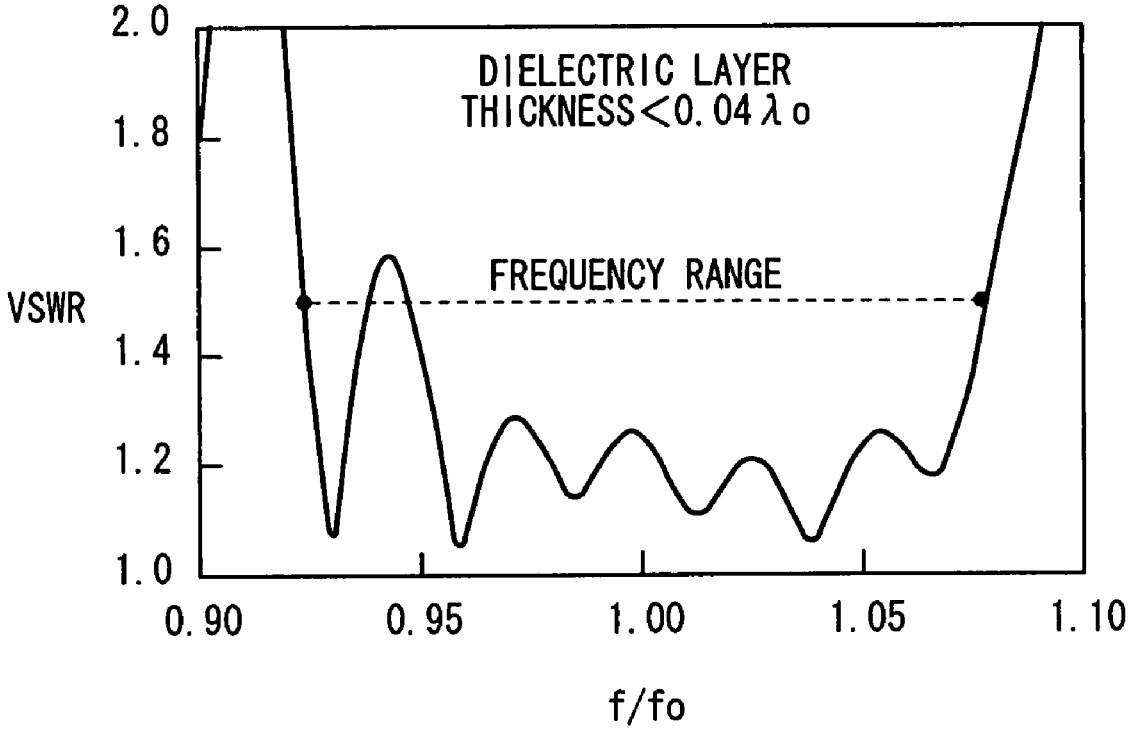
FIG. 5 is a graph showing a relationship between VSWR and f/f0, when a dielectric layer has a thickness of less than 0.04λ0.

As shown in FIGS. 4 and 5, when the lower and upper side dielectric layers 120, 140 (see FIGS. 2 and 3) respectively have thicknesses of less than 0.04λ0, the VSWR within the frequency range (f/f0=0.925 to 1.075) of the triplate planar slot antenna 100 is higher than the VSWR (1.5) indicated by the dotted line, within a certain frequency domain. As a result, the frequency range within which the triplate planar slot antenna 100 is usable is narrower than the above-mentioned frequency range. Specifically, the usable frequency range is limited to f/f0 ranging from 0.96 to 1.075 in FIG. 4, and the usable frequency range is limited to f/f0 ranging from 0.96 to 1.075 in FIG. 5.

Figure 7:
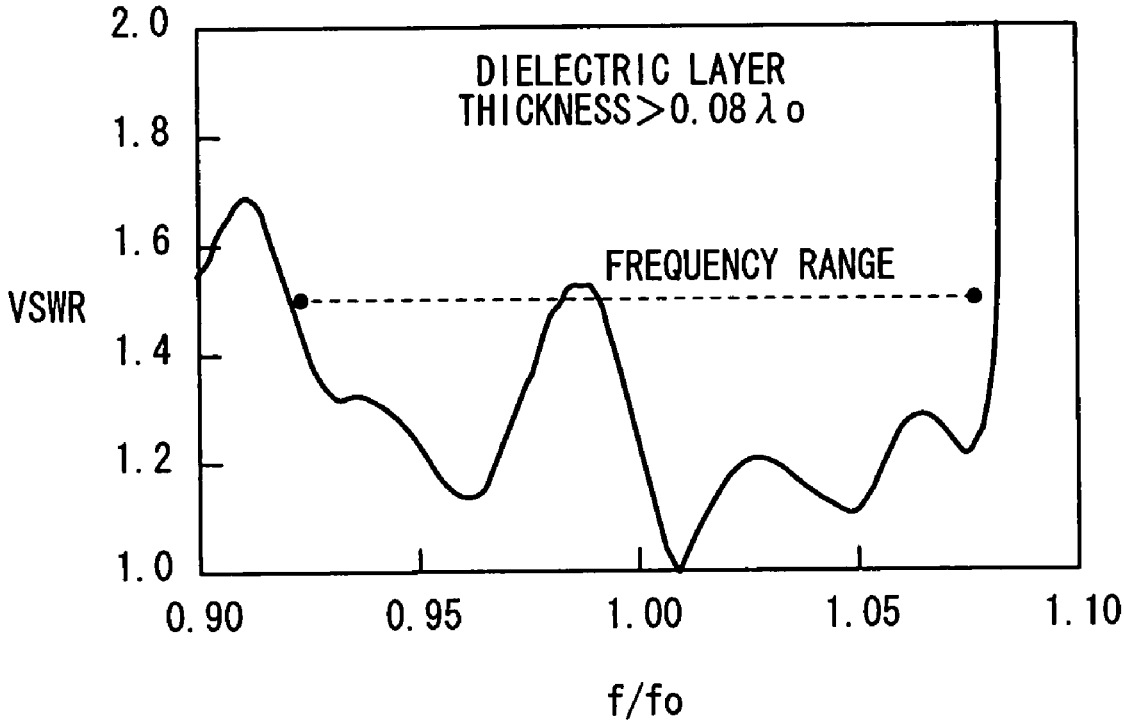
FIG. 7 is a graph showing a relationship between VSRW and f/f0, when a dielectric layer has a thickness exceeding 0.08λ0.
Figure 8:
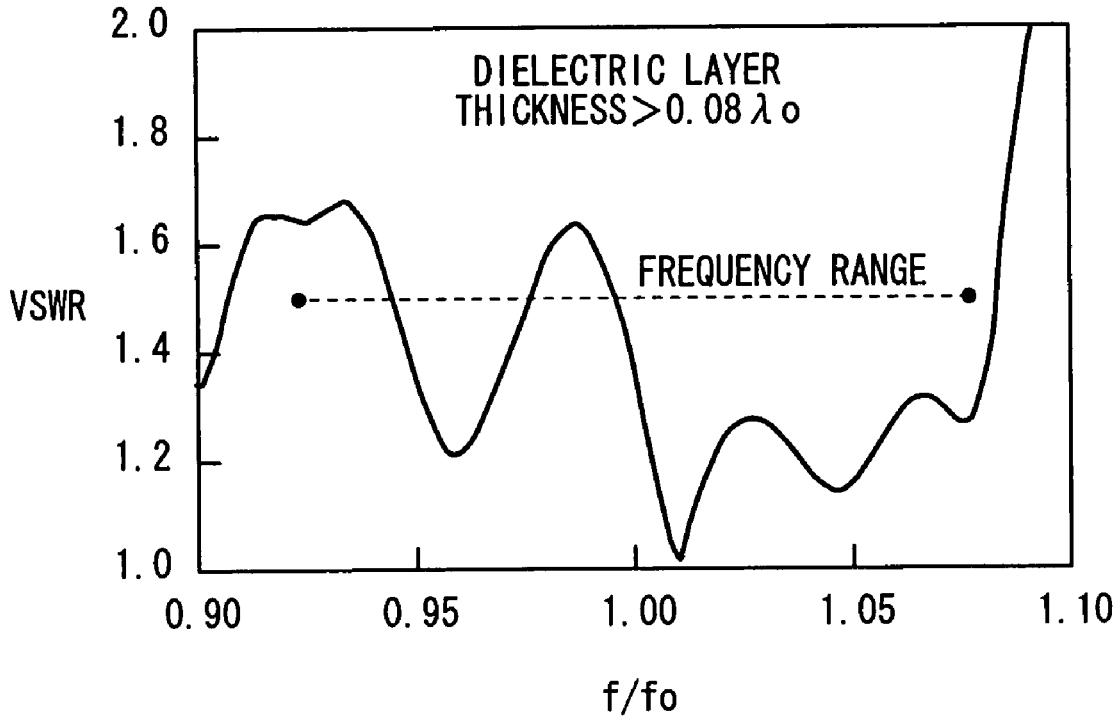
FIG. 8 is a graph showing a relationship between VSRW and f/f0, when a dielectric layer has a thickness in excess of 0.08λ0.

Also, as shown in FIGS. 7 and 8, when the lower and upper side dielectric layers 120, 140 (see FIGS. 2 and 3) respectively have thicknesses exceeding 0.08λ0, the VSWR within the frequency range (f/f0=0.925 to 1.075) of the triplate planar slot antenna 100 is higher than the VSWR (1.5) indicated by the dotted line, within a certain frequency domain. In this case, the usable frequency range for the triplate planar slot antenna 100 is also narrower than the above-mentioned frequency range. Specifically, the usable frequency range is limited to f/f0 ranging from 0.925 to 0.97 and f/f0 ranging from 1.00 to 1.075 in FIG. 7, and the usable frequency range is limited to f/f0 ranging from 0.95 to 0.975 and f/f0 ranging from 1.00 to 1.075 in FIG. 8.

Figure 6:
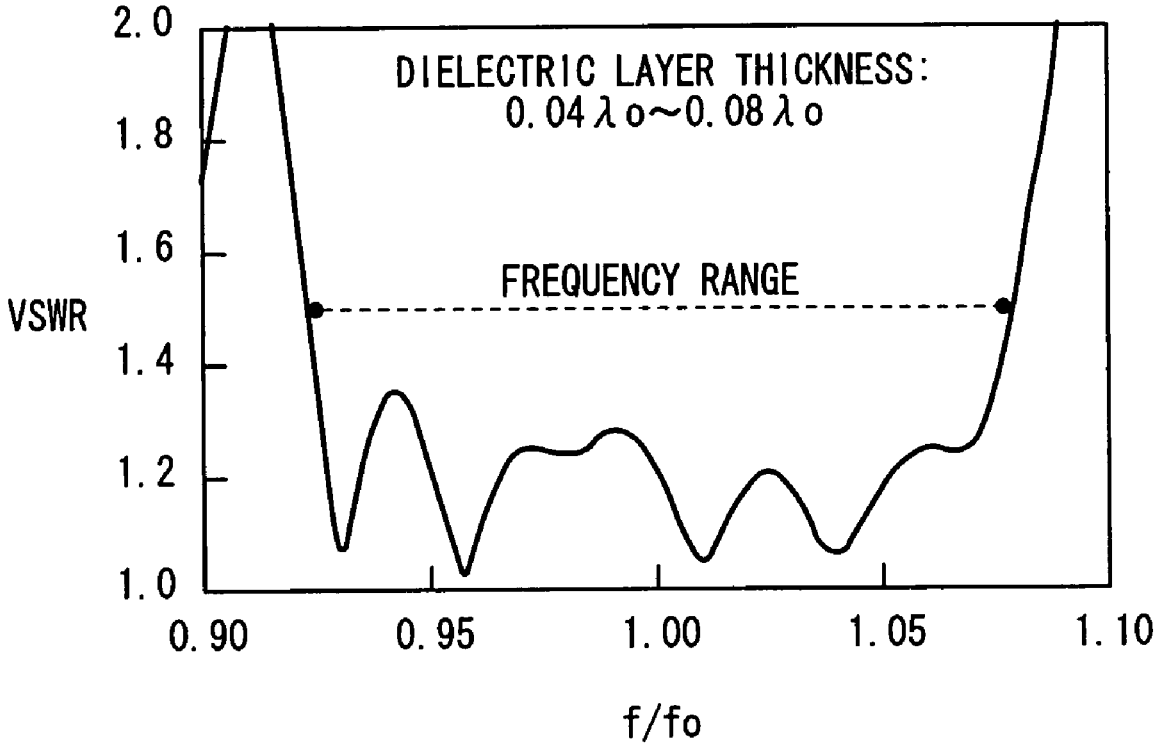
FIG. 6 is a graph showing a relationship between VSRW and f/f0, when a dielectric layer has a thickness ranging from 0.04λ0 to 0.08λ0.

On the other hand, as shown in FIG. 6, when the lower and upper side dielectric layers 120, 140 (see FIGS. 2 and 3) respectively have thicknesses ranging from 0.04λ0 to 0.08λ0, the VSWR within the frequency range (f/f0=0.925 to 1.075) of the triplate planar slot antenna 100 is lower than the VSWR (1.5) indicated by the dotted line, at any frequency within the above-mentioned frequency range. Thus, the usable frequency range for the triplate planar slot antenna 100 corresponds to the above frequency range. That is, in the triplate planar slot antenna 100 according to the embodiment of the present invention, the usable frequency range thereof is maximized when the lower and upper side dielectric layers 120, 140 (see FIGS. 2 and 3) respectively have thicknesses ranging from 0.04λ0 to 0.08λ0 at the center frequency f0.

As mentioned above, in the triplate planar slot antenna 100 according to the embodiment of the present invention, the copper foil pieces 132, 162 are fixed, by adhesiveless bonding, respectively onto the insulating film 131 of the lower side copper clad film substrate 130 and onto the insulating film 161 of the upper side copper clad film substrate 160, so as to reduce the relative permittivity and dielectric loss tangent of each of the insulating films 131, 161, from which the copper foil pieces 132, 162 and the feed path 136 have been removed.

In this case, since the relative permittivity and dielectric loss tangent of the adhesive are higher than those of the insulating films 131, 161, when the copper foil pieces 132, 162 are fixed respectively onto the insulating films 131, 161 by means of adhesiveless bonding, each of the insulating films 131 and 161, from which the copper foil pieces 132, 162 have been removed, has a relative permittivity (2.0 to 4.0) and a dielectric loss tangent (0.001 to 0.01) which are equal to those inherent in the insulating films 131, 161 themselves. As mentioned above, due to use of adhesiveless bonding, the relative permittivity and dielectric loss tangent can be prevented from increasing, thereby reducing the dielectric loss tangent. As a result, a high-efficiency triplate planar slot antenna 100 can be realized, even if the antenna is made larger in size.

Further, according to the embodiment of the present invention, since the triplate structure, comprising the lower side dielectric layer 120, the lower side insulating film 131 and the upper side dielectric layer 140, has a total relative permittivity of 1.0 to 1.1, the working frequency range of the triplate planar slot antenna 100 can be enlarged. Further, when the thickness of each of the dielectric layers 120, 140 is set to 0.04λ0 to 0.08λ0, variations in antenna characteristics between antennas can be prevented, even if the working frequency range thereof is wide.

Conventionally, each of the insulating films has a thickness of substantially 50 μm, so that the thickness of each of the insulating films is smaller than that of each of the dielectric layers. According to the embodiment of the present invention, each of the insulating films 131, 161 has a thickness of 25 μm or less, thereby reducing dielectric loss. Thus, the triplate planar slot antenna 100 can be made more efficient.

Further, according to the embodiment of the present invention, when the relative permittivity of each of the dielectric layers 120, 140 is set to 1.0 to 1.2, and the working frequency of the triplate planar slot antenna 100 is set to a range of from 15 GHz to 40 GHz, the triplate planar slot antenna 100 can operate more efficiently in a high-frequency range.

Still further, according to the embodiment of the present invention, when each of the dielectric layers 120, 140 is formed from an insulating foam sheet, the total relative permittivity is reduced due to the lower relative permittivity of the dielectric layers 120, 140. Accordingly, the efficiency of the triplate planar slot antenna 100 can be reliably improved. Also, the foam is more uniformly distributed inside of the sheet-like foam material, as compared to a block-like foam material, and the surfaces thereof have a relatively small amount of foam in the sheet-like foam material. Thus, when the foam sheet is formed by slicing the sheet-like foam material at surfaces thereof, variations in antenna characteristic between antennas can be further controlled.

It is a matter of course that the triplate planar slot antenna of the present invention is not limited to the embodiments described above, and the antenna can be constructed in other various forms, without deviating from the gist or essential characteristics of the present invention.

INDUSTRIAL APPLICABILITY

According to the present invention, the copper foil pieces are fixed by adhesiveless bonding respectively onto the insulating films of the lower side copper clad film substrate and the upper side copper clad film substrate, thereby reducing the relative permittivity and dielectric loss tangent of each of the insulating films from which the copper foil pieces have been removed.

In this case, since the relative permittivity and dielectric loss tangent of the adhesive is higher than that of the insulating films, when the copper foil pieces are fixed respectively onto the insulating films by adhesiveless bonding, each of the insulating films, from which the copper foil pieces have been removed, has a relative permittivity (2.0 to 4.0) and dielectric loss tangent (0.001 to 0.01) equal to the inherent relative permittivity and dielectric loss tangent of the insulating films. As mentioned above, due to use of adhesiveless bonding, the relative permittivity and dielectric loss tangent can be prevented from increasing, thereby reducing the dielectric loss tangent. As a result, a high-efficiency triplate planar slot antenna can be realized, even if the antenna is made larger in size.

Incidentally, the above-mentioned adhesiveless bonding technology comprises a method for fixing the copper foil pieces onto surfaces of the insulating films without an adhesive, i.e., by means of pressure welding, including press working, such as with use of a hot press.

Also, according to the present invention, since the structure made up of the lower side dielectric layer, the lower side insulating film and the upper side dielectric layer has a total relative permittivity of 1.0 to 1.1, the working frequency range of the triplate planar slot antenna can be enlarged. Further, when the thickness of each of the dielectric layers is set to 0.04λ0 to 0.08λ0, variations in antenna characteristics between antennas can be prevented, even if the working frequency range is wide.

Incidentally, the term "total relative permittivity" means the overall relative permittivity, in which the lower side dielectric layer, the lower side insulating film and the upper side dielectric layer are regarded collectively as making up one dielectric material.

Conventionally, each of the insulating films has a thickness substantially of 50 μm, so that the thickness of each of the insulating films is smaller than that of each of the dielectric layers. According to the present invention, each of the insulating films has a thickness of 25 μm or less, thereby reducing dielectric loss. Thus, the triplate planar slot antenna can operate more efficiently.

Further, according to the present invention, when the relative permittivity of each of the dielectric layers is set to 1.0 to 1.2, and the working frequency of the triplate planar slot antenna is set in a range of from 15 GHz to 40 GHz, the triplate planar slot antenna can be made more efficient in a high-frequency range.

Still further, according to the present invention, when each of the dielectric layers is formed from an insulating foam sheet, total relative permittivity is reduced due to the lower relative permittivity of the dielectric layers. Accordingly, efficiency of the triplate planar slot antenna can be improved reliably. Also, the foam is more uniformly distributed inside of the sheet-like foam material, compared to a block-like foam material, and the surfaces have a relatively small amount of foam within the sheet-like foam material. Thus, when the foam sheet is formed by slicing the sheet-like foam material at the surfaces thereof, variations in characteristics between antennas can be further controlled.

Furthermore, in the above triplate planar slot antenna, each of the insulating sheets comprises a liquid crystal polymer having a low hygroscopicity, and thus the antenna is less subject to developing deteriorated characteristics, even when used in high-humidity environments.

The invention claimed is:

1. A triplate planar slot antenna comprising:

a ground plate;

a lower side dielectric layer;

a lower side copper clad film substrate;

an upper side dielectric layer;

a slot plate; and an upper side copper clad film substrate, wherein said triplate planar slot antenna is formed by successively laminating, starting from a bottom side thereof, said ground plate, said lower side dielectric layer, said lower side copper clad film substrate, said upper side dielectric layer, said slot plate and said upper side copper clad film substrate, wherein said lower side copper clad film substrate comprises a lower side insulating film and a lower side copper foil piece fixed onto a surface of said lower side insulating film by adhesiveless bonding, wherein said upper side copper clad film substrate comprises an upper side insulating film and an upper side copper foil piece fixed onto a surface of said upper side insulating film by adhesiveless bonding, and wherein each of said insulating films from which only said copper foil pieces have been removed has, within a working frequency thereof, a relative permittivity ranging from 2.0 to 4.0, and a dielectric loss tangent ranging from 0.001 to 0.01.

2. A triplate planar slot antenna according to claim 1, wherein each of said insulating films has a thickness of 25 μm or less.

3. A triplate planar slot antenna according to claim 1, wherein each of said dielectric layers has a relative permittivity ranging from 1.0 to 1.2.

4. A triplate planar slot antenna according to claim 1, wherein each of said dielectric layers comprises an insulating foam sheet.

5. A triplate planar slot antenna according to claim 4, wherein said foam sheet is formed by slicing a sheet-like foam material on either surface thereof.

6. A triplate planar slot antenna according to claim 1, wherein each of said insulating films comprises a liquid crystal polymer.

7. A triplate planar slot antenna according to claim 1, wherein said working frequency ranges from 15 GHz to 40 GHz.

8. A triplate planar slot antenna comprising:

a ground plate;

a lower side dielectric layer;

a lower side copper clad film substrate;

an upper side dielectric layer;

a slot plate; and an upper side copper clad film substrate, wherein said triplate planar slot antenna is formed by successively laminating, starting from a bottom side thereof, said ground plate, said lower side dielectric layer, said lower side copper clad film substrate, said upper side dielectric layer, said slot plate and said upper side copper clad film substrate, wherein said lower side copper clad film substrate comprises a lower side insulating film and a lower side copper foil piece fixed onto a surface of said lower side insulating film by adhesiveless bonding, wherein said upper side copper clad film substrate comprises an upper side insulating film and an upper side copper foil piece fixed onto a surface of said upper side insulating film by adhesiveless bonding, wherein each of said dielectric layers has a thickness ranging from $0.04\lambda 0$ to $0.08\lambda 0$, where $\lambda 0$ represents a free space wavelength at a center frequency in a frequency range of said triplate planar slot antenna, and a total relative permittivity of said lower side dielectric layer, said lower side insulating film and said upper side dielectric layer is in a range from 1.0 to 1.1 within a working frequency of said triplate planar slot antenna.

* * * * *